US006175708B1

(12) United States Patent
Ohashi et al.

(10) Patent No.: US 6,175,708 B1
(45) Date of Patent: Jan. 16, 2001

(54) BLADE MEMBER, BLADE MEMBER MANUFACTURING METHOD, DEVELOPING UNIT HAVING BLADE MEMBER, AND IMAGE FORMING APPARATUS HAVING DEVELOPING UNIT

(75) Inventors: Tsuneo Ohashi, Kawaguchi; Koji Iwai, Ibaraki-ken, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/379,609

(22) Filed: Aug. 24, 1999

(30) Foreign Application Priority Data

Aug. 26, 1998 (JP) ..... 10-240248
Jul. 8, 1999 (JP) ..... 11-194287

(51) Int. Cl.[7] ..... G03G 15/08
(52) U.S. Cl. ..... 399/274; 118/261
(58) Field of Search ..... 399/274, 411; 118/261, 413

(56) References Cited

U.S. PATENT DOCUMENTS 4,406,536 * 9/1983 Suzuki et al. .
4,583,490 * 4/1986 Kan et al. .
4,592,987 * 6/1986 Mitsuhashi et al. ..... 430/102
4,615,608 * 10/1986 Mizutani .

* cited by examiner

*Primary Examiner*—Richard Moses
(74) *Attorney, Agent, or Firm*—Fitzpatrick, Cella, Harper & Scinto

(57) ABSTRACT

To prevent formation of a white streaking line on an image by a blade member for a developing unit in an image forming apparatus, a blade member is formed by welding magnetic and nonmagnetic members to each other by laser irradiation. The laser beam is pulsed so that the laser beam irradiating a welding portion is in-focus or out-of-focus.

7 Claims, 10 Drawing Sheets

MAGNETIC FLUX DENDITY CHANGES IN ACCORDANCE WITH DISTANCE (= WELD PENETRATION DEPTH ) THROUGH WHICH LINE OF MAGNETIC FORCE IS TRANSMITTED THROUGH MAGNETIZED MOLTEN PORTION

BLADE MEMBER, BLADE MEMBER MANUFACTURING METHOD, DEVELOPING UNIT HAVING BLADE MEMBER, AND IMAGE FORMING APPARATUS HAVING DEVELOPING UNIT

BACKGROUND OF THE INVENTION

The present invention relates to a blade member, a blade member manufacturing method, a developing unit having a blade member, and an image forming apparatus having a developing unit and, more particularly, to a member or blade member used in an image forming apparatus such as a copying machine, a laser beam printer, or the like to adjust the amount of toner.

A copying machine or laser beam printer has a blade member incorporated in its developing unit to serve as a toner amount adjusting member. When the toner of the developing unit is attached to a latent image photosensitized on a photosensitive drum to develop the image, the blade member adjusts the amount of toner of the developing unit. This will be described with reference to the accompanying drawings. FIG. 1 shows a sectional view of the main part of a developing unit manufactured by the present applicant.

Referring to FIG. 1, reference numeral 1 denotes the case of a developing unit; 2, a photosensitive drum; 4, a developing sleeve; 6, a magnet mounted in the developing sleeve 4; and 8 and 10, toner agitating screws, respectively.

Reference numeral 12 denotes a blade member according to the present invention. The blade member 12 is fixed to blade holding members 16 and 18 with a blade attaching member 14.

FIG. 2 shows a partial enlarged view of the structure of a position near the distal end of the blade member 12 and the developing sleeve 4. As shown in FIG. 2, the distal end of the blade member 12 is constituted by two metal members. A first metal member 12A is made of a nonmagnetic material. A distance between a distal end position 12A-a of the first metal member 12A and the outer surface of the developing sleeve 4 is adjusted to adjust the toner amount. A second metal member 12B is made of a magnetic material, and constitutes a magnetic circuit together with a magnet in the developing sleeve 4 to attract the toner. Accordingly, the blade member 12 having the above arrangement is constituted by the two metal members, one of which is composed of the magnetic member.

SUMMARY OF THE INVENTION

The blade member 12 is formed by joining the member 12A as the nonmagnetic member to the member 12B as the magnetic member. The blade member 12 is to collide against the toner being agitated in the developing unit to receive an impact from it. Accordingly, the two metal members must be joined with a joining force that can stand the collision and impact.

For example, when an adhering is employed, the toner enters the mating portion between the nonmagnetic member 12A and magnetic member 12B to cause peeling of the bonded portion.

Welding is available as a method of increasing the weld strength of the mating portion.

Various methods are available for welding the two metal members. To assure the weld strength, methods such as laser welding and arc welding are available.

The first metal member as the nonmagnetic member must have a high mechanical strength as it collides against and comes into contact with the toner being agitated. As the material for the first metal member, austenite-based stainless (SUS) steel which is not attracted to a magnet is employed. This stainless steel, however, may be influenced by heat generated by welding.

More specifically, when stainless steel is melted (at about 1,500° C. which the melting temperature of a steel plate), carbon steel as the main component transforms from the austenite phase to pearlite phase. Ferrite is produced at the pearlite portion and magnetized.

When the nonmagnetic member as the first metal member and the magnetic member as the second metal member are welded to each other by laser welding or arc welding requiring a high melting temperature, since the structure that has changed to pearlite has been magnetized, the magnetized portion of the welded portion adversely affects the function as the blade member.

More specifically, when the blade member is attached to the developing unit and used to adjust the toner amount, since the structure that has changed to pearlite is magnetized, the toner attaches to this pearlite portion upon using the blade member. This forms a white streaking line at a portion to be developed, which is a defect in the developing performance.

In particular, in a color image developing system, an influence on a halftone image increases.

Furthermore, in the blade member which adjusts the toner amount of the image forming apparatus, the precision of its straightness is important. A blade member obtained by a welding method, the heat energy of which is difficult to adjust, has a problem in guaranteeing the straightness.

In order to solve the above problems, according to the present invention, there is provided a blade member for adjusting an amount of image forming toner for an image forming apparatus, wherein members constituting the blade member are a nonmagnetic member and a magnetic member.

There is also provided a blade member characterized in that the nonmagnetic and magnetic members are welded to each other intermittently by laser irradiation.

There is also provided a blade member wherein, when welding magnetic and nonmagnetic members to each other by laser irradiation of a laser beam, the laser beam is pulsed, and the laser beam to irradiate a welding portion is an in-focused state or a defocused state.

According to an aspect of the present invention, there is also provided a blade member for an image forming apparatus, in which when welding a nonmagnetic material and a magnetic material to each other, a heat energy for a welding portion can be adjusted by controlling the pulse wave of a YAG laser, so that a weld penetration depth and welding area of the nonmagnetic and magnetic materials can be adjusted.

In particular, magnetization of the metal structure of the nonmagnetic material can be prevented by controlling the YAG laser by means of pulsed-laser irradiation time.

Furthermore, there is provided a blade member in which a change in magnetic flux density of a portion of the magnetic member irradiated with a laser beam is set to be 10 G or less, so the problem of white streaking line formed on the image is solved.

Furthermore, according to the present invention, there is provided a method of manufacturing a blade member composed of a first metal member having a toner amount adjusting portion and a second metal member to be joined to the first metal member, characterized in that the first and second metal members are joined to each other by welding with intermittent irradiation of a laser beam in a longitudinal direction, and an irradiation energy is adjusted so as not to change a structure of the first metal member by the laser beam, thereby solving the above problems.

According to an aspect of the present invention, there is provided a method of manufacturing a blade member wherein the first metal member is austenite-based stainless steel.

In order to solve the problems of the developing unit described above, there is provided a developing unit for an image forming apparatus, characterized in that a blade member obtained by welding a nonmagnetic member and a magnetic member to each other by laser irradiation is used to adjust a toner amount.

There is also provided an image forming apparatus characterized by comprising a developing unit in which a blade member obtained by welding a nonmagnetic member and a magnetic member to each other by laser irradiation is used to adjust a toner amount.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

The preferred embodiment of the present invention will be described with reference to the accompanying drawings.

Figure 1:
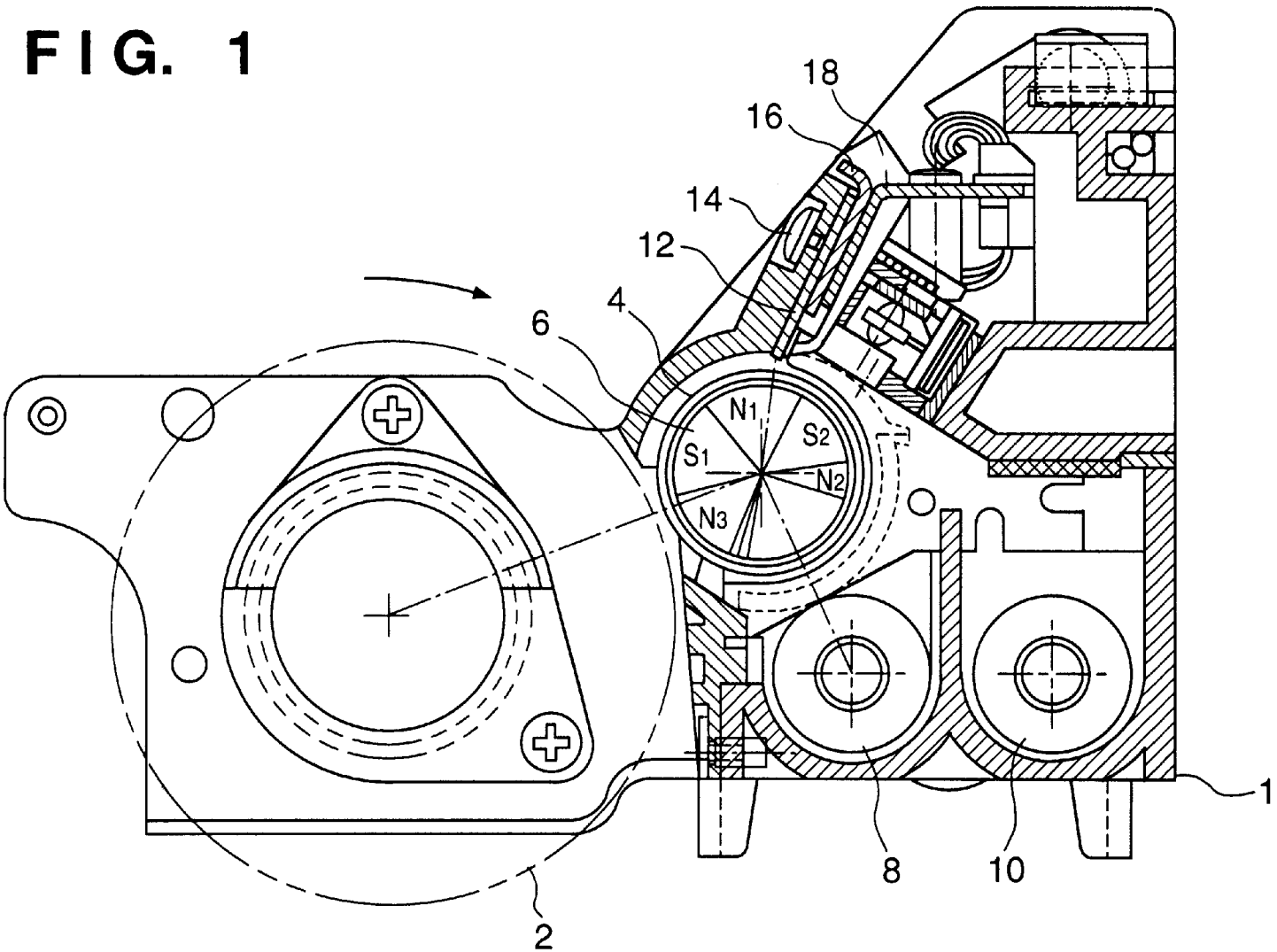
FIG. 1 is a view showing the arrangement of a developing unit that uses a blade member according to the present invention.
Figure 2:
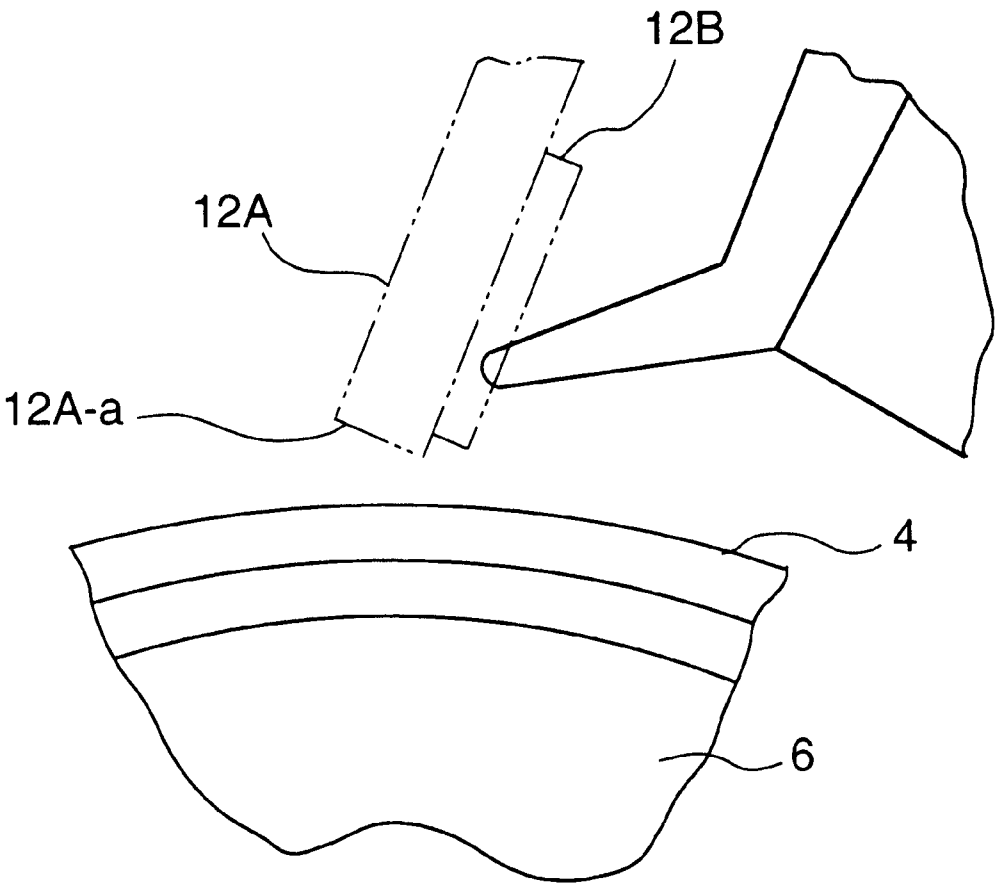
FIG. 2 is a partial enlarged view showing the blade member and developing sleeve shown in FIG. 1.
Figure 3:
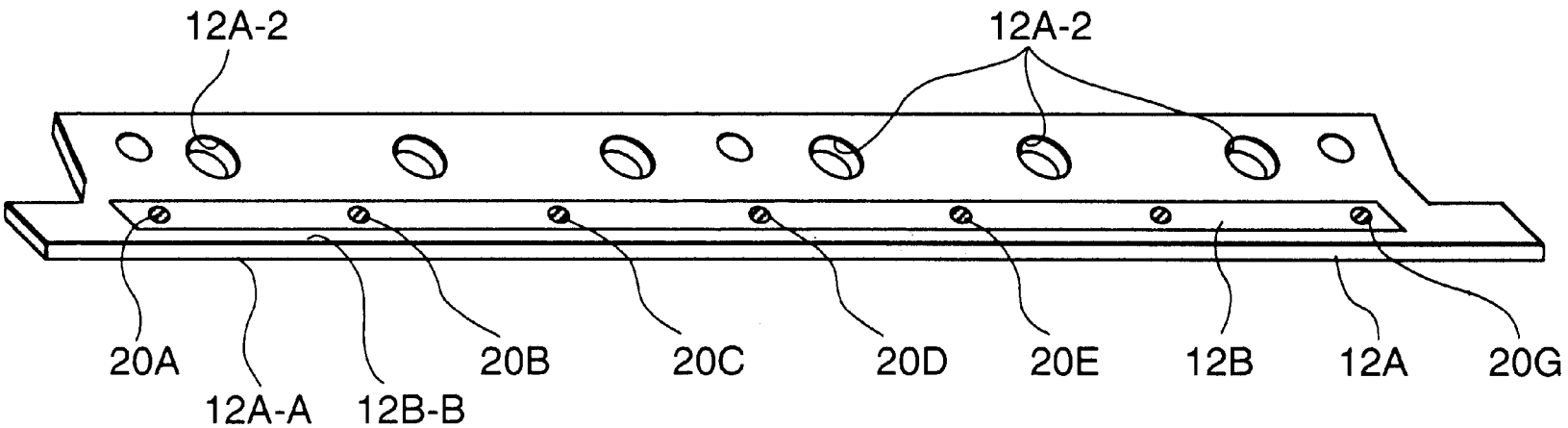
FIG. 3 is a perspective view of the blade member according to the present invention.

FIG. 3 is a perspective view of a blade member 12 according to the present invention.

As a first metal member 12A, nonmagnetic austenite-based stainless steel (SUS 304 Japanese Industrial Standards JIS) was employed. As a nonmagnetic member 12B of the second metal member, a cold-rolled steel plate (SPCC-SD Japanese Industrial Standards JIS) was employed.

Black dots 20A, 20B, 20C, . . . , and 20G in FIG. 3 indicate laser-welded portions of the first and second metal members.

The first metal member 12A has a length of 324 mm and a thickness of 1.2 mm. The second metal member 12B has a length of 301.8 mm, a thickness of 0.5 mm, and a width of 4 mm. The welding pitch is 52 mm.

Reference numerals 12A-2 denote attaching holes with which the blade member is attached to the developing unit.

Figure 4:
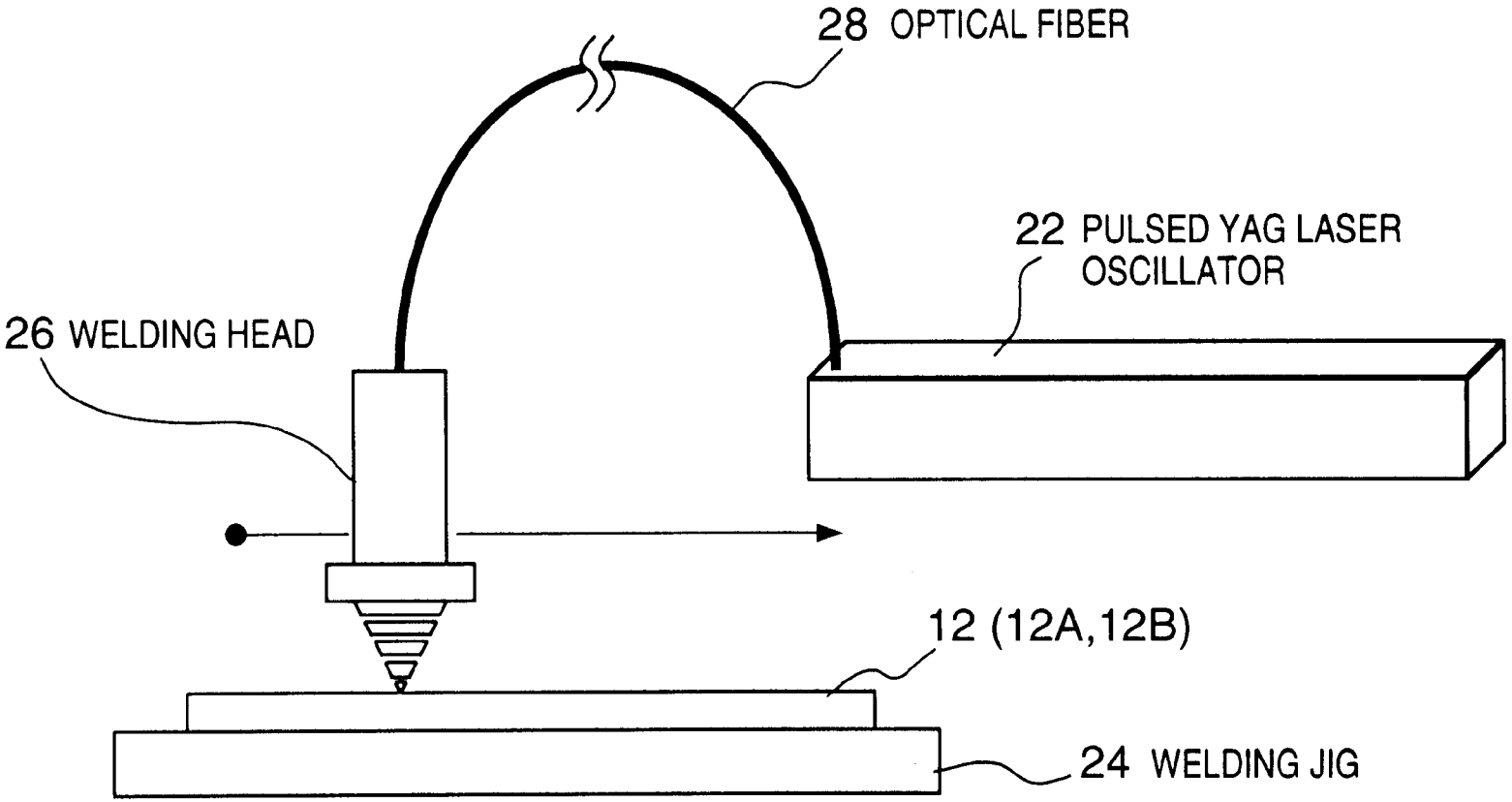
FIG. 4 is a view explaining a pulsed laser unit.

FIG. 4 is a view showing the main part of the arrangement of a welding unit. According to the characteristic feature of the present invention, the nonmagnetic first metal member 12A and the magnetic second metal member 12B are welded by irradiation of a laser beam which is in an in-focused state or a defocused state with respect to the welding portion.

Also, the amount of laser energy is adjusted by the pulsed laser beam, so the weld strength can be set and adjusted.

By employing the pulsed laser, transformation of the nonmagnetic austenite-based structure into a pearlite structure can be prevented, and a white streaking line on the image can be eliminated.

Referring to FIG. 4, reference numeral 22 denotes a laser oscillator; 24, a welding jig; 26, a welding head; and 28, an optical fiber. The second metal member 12B is placed on the first metal member 12A. The welding jig 24 fixes the first and second metal members 12A and 12B such that an end face 12A-A of the former and an end face 12B-B of the latter are positioned to be displaced from each other by 0.3 mm±0.05 mm (see FIG. 3).

Figure 5:
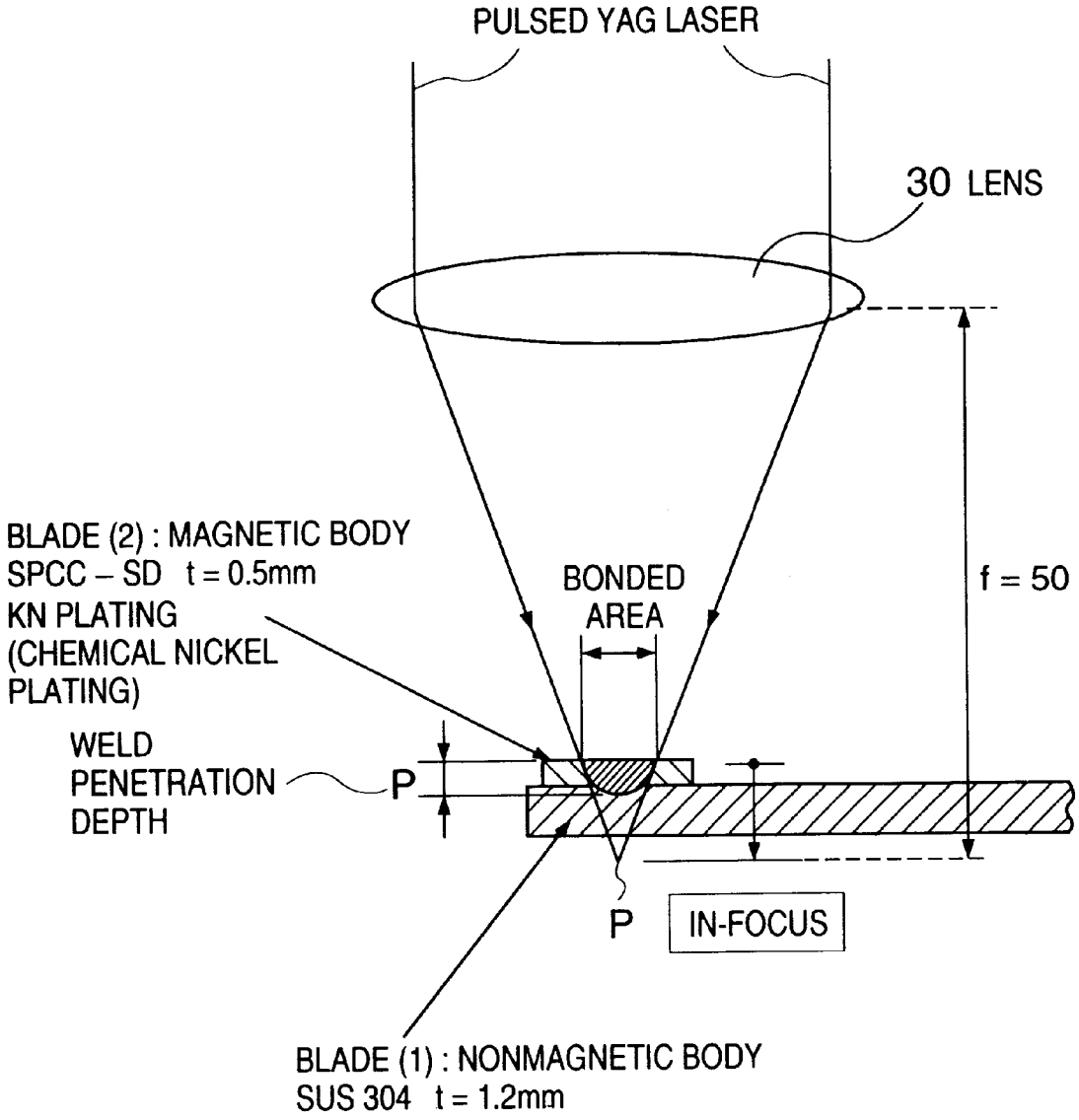
FIG. 5 is a view explaining irradiation of the pulsed laser.

FIG. 5 is a view showing irradiation of the pulsed laser output from the welding head 26 of the welding unit shown in FIG. 4 toward the welding target member 12.

In this case, a YAG laser is used as the laser beam. The laser beam focused by a lens 30 is set such that its focal point P is in the in-focused state at a position outside the welding target member 12.

| Unit/Condition<br>Pulsed YAG laser unit | |
|---|---|
| Oscillation wavelength | 1.064 $\mu$m |
| Beam diameter | 10 mm |
| Beam diversion angle | 10 mrad |
| Oscillation output | 50 J at maximum |
| Pulse width | 0.1 ms to 9.9 ms |
| Fiber | SI fiber<br>Fiber diameter = 0.8 mm |
| Condenser lens | f: 50 mm |

Figure 6:
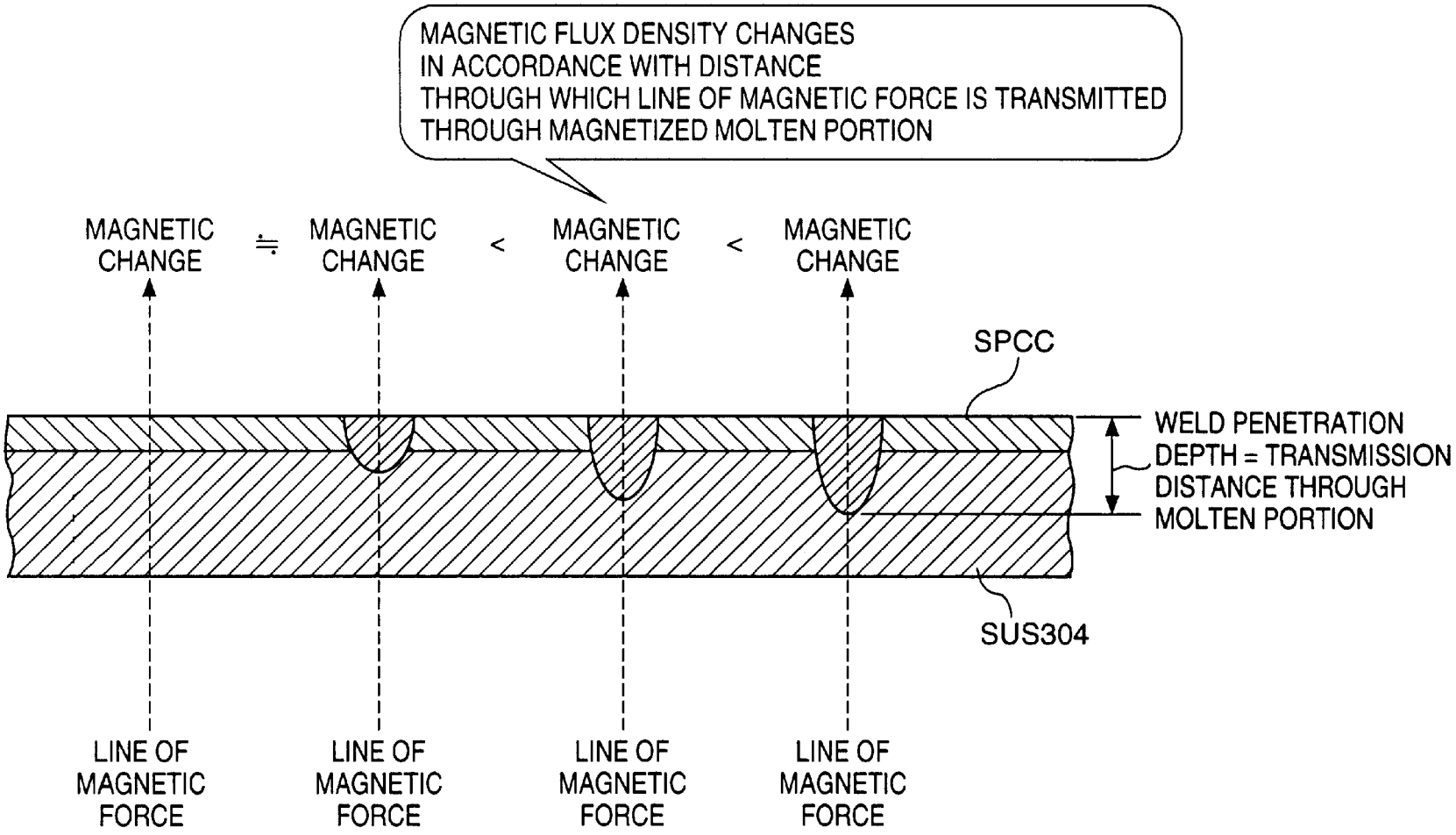
FIG. 6 is a view showing the weld penetration depth of a welded member upon irradiation of the pulsed laser.

A welding position set on the welding target member 12 fixed on the jig 24 of the above unit is irradiated with a pulsed YAG laser beam. As shown in FIG. 6, the weld penetration depth (the distance through which the laser beam is transmitted through the molten portion) differs depending on a laser beam focal position in the direction of depth of the overlapping first and second metal members 12A and 12B. This determines the amount of transformation of the austenite structure of the first metal into a pearlite structure.

The amount of transformation into the pearlite structure corresponds to the size of the region to be magnetized, influencing the magnitude of a change in magnetic flux density and the state of a white streaking line.

A weld penetration depth P (FIG. 5) is determined by the product of the pulse peak output (kW) as the heat energy and the irradiation time (ms).

Furthermore, the weld penetration depth is associated with the weld penetration amounts of the first and second metal members, i.e., their welding volume.

As shown in FIGS. 5 and 6, the present inventor has found that, by setting the focal position of the laser beam in the in-focus or defocused state, transformation of austenite-based stainless steel into the pearlite phase can be prevented and high weld strength of the first and second metal members can be obtained.

Figure 7A:
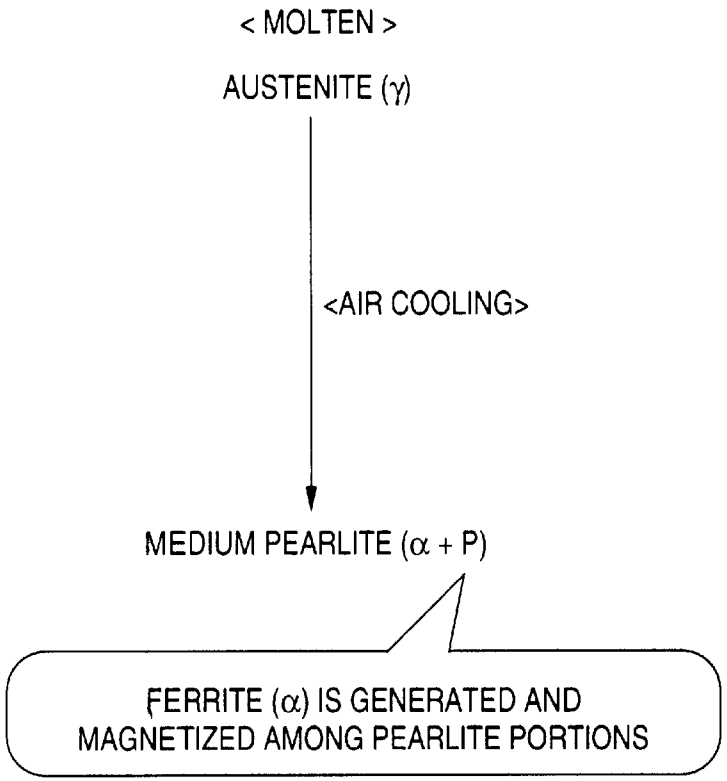
FIGS. 7A and 7B are views showing transformation of a stainless steel structure.
Figure 7B:
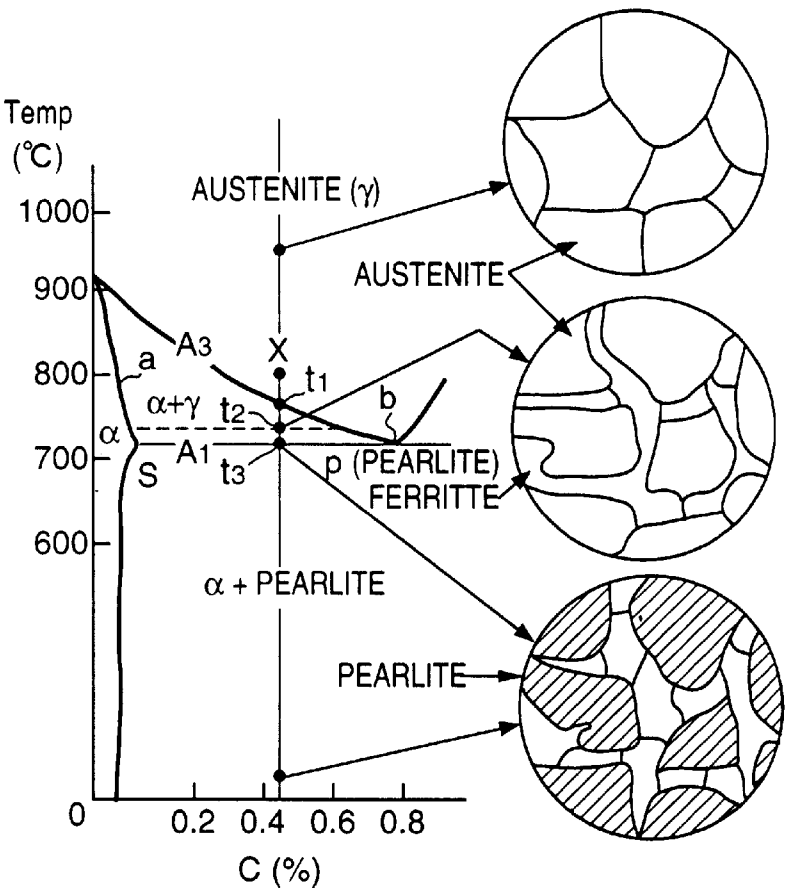

FIGS. 7A and 7B are views showing transformation of the stainless steel structure. In FIG. 7B, the axis of ordinate represents the temperature and the axis of abscissa represents the proportion of the transformation amount.

FIG. 7B shows a state wherein part of the caustenite structure is transformed into the pearlite phase depending on the temperature condition of the laser-irradiated portion to generate ferrite among pearlite portions.

Figure 8:
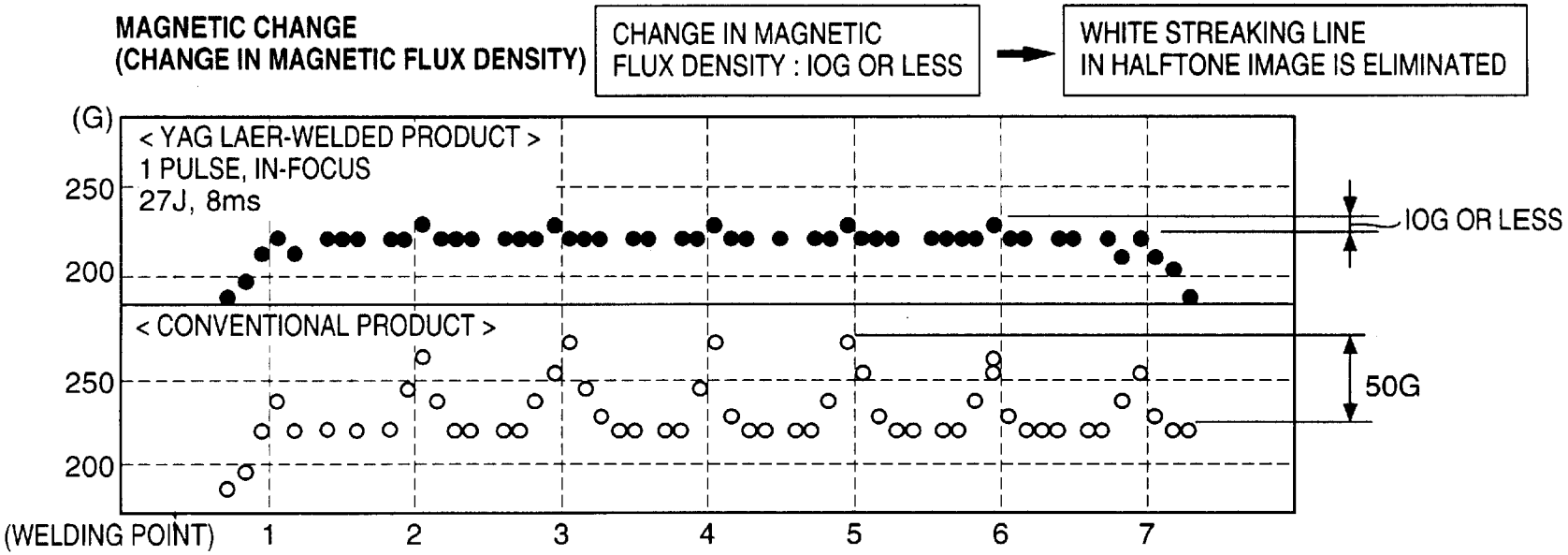
FIG. 8 is a view showing a change in magnetic flux density at joining points.

FIG. 8 shows the distribution of the measurement values of the magnetic flux density at welded ferrite portions when an in-focused operation of laser irradiation is not performed.

In part A of FIG. 8, the gauss value exceeds 250 G at six portions. A change in magnetic flux density of 50 G is measured, leading to variations in distribution.

White streaking lines are formed at these welding positions during development.

Part B of FIG. 8 shows a case using a manufacturing method according to the present invention. The gauss value at the welded portions is below 230 G. A change in magnetic flux density is equal to or less than 10 G.

Figure 9:
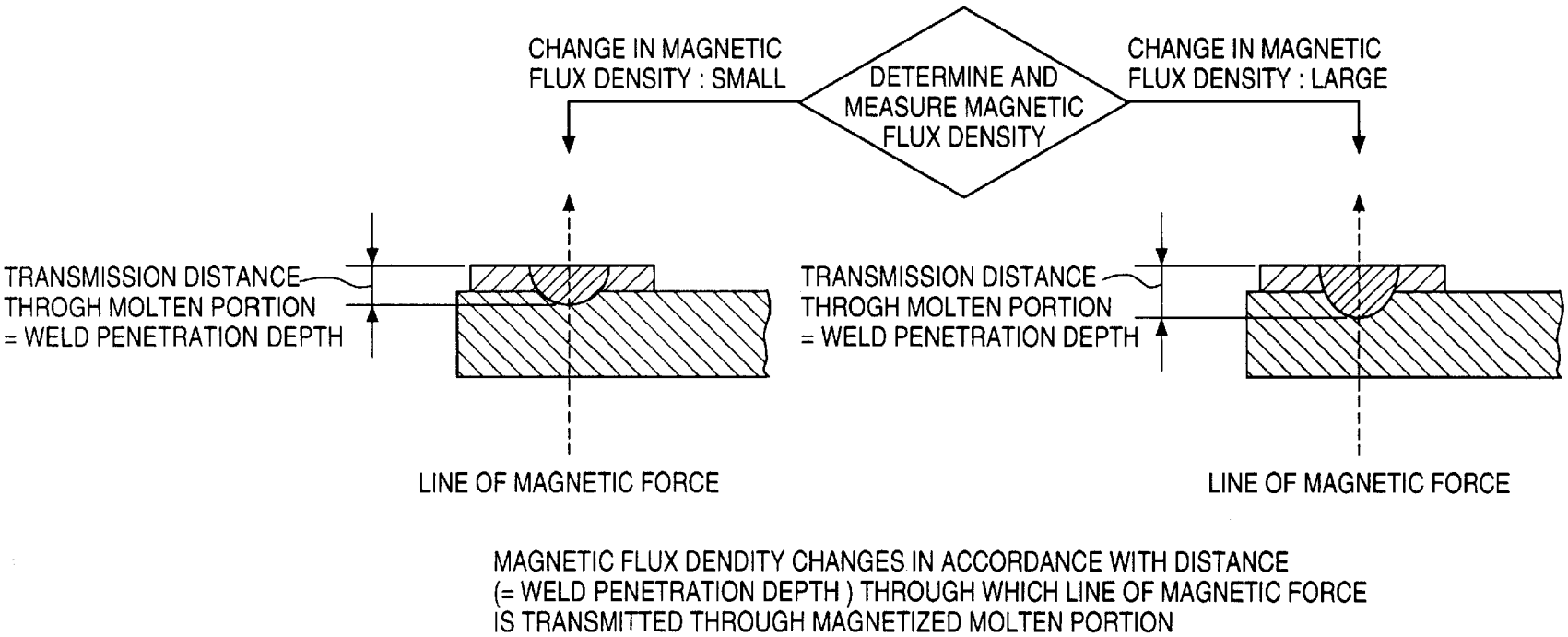
FIG. 9 is a view showing the weld penetration depth and the magnetic flux density.

When a blade member was manufactured according to this method, the weld strength of the welding point of the first and second members had a tensile strength of 29.4 N or more. A sufficiently high strength was obtained. The focal position of the laser beam was set in the in-focus or defocus state, as shown in FIG. 9, and welding was performed. A change in magnetic flux density at the central position of the welding position of the first and second metal members 12A and 12B was measured. Simultaneously, the resultant blade member 12 was attached to the developing unit, and an image formation test was performed.

The result is as follows. When a blade member formed by welding in the in an in-focused state or a defocused state state such that variations in magnetic flux density became 10 G or less was used, no white streaking line was formed in the image. The straightness of the resultant blade member was 0.03 or less within a length of 324 mm of the first member.

Figure 10:
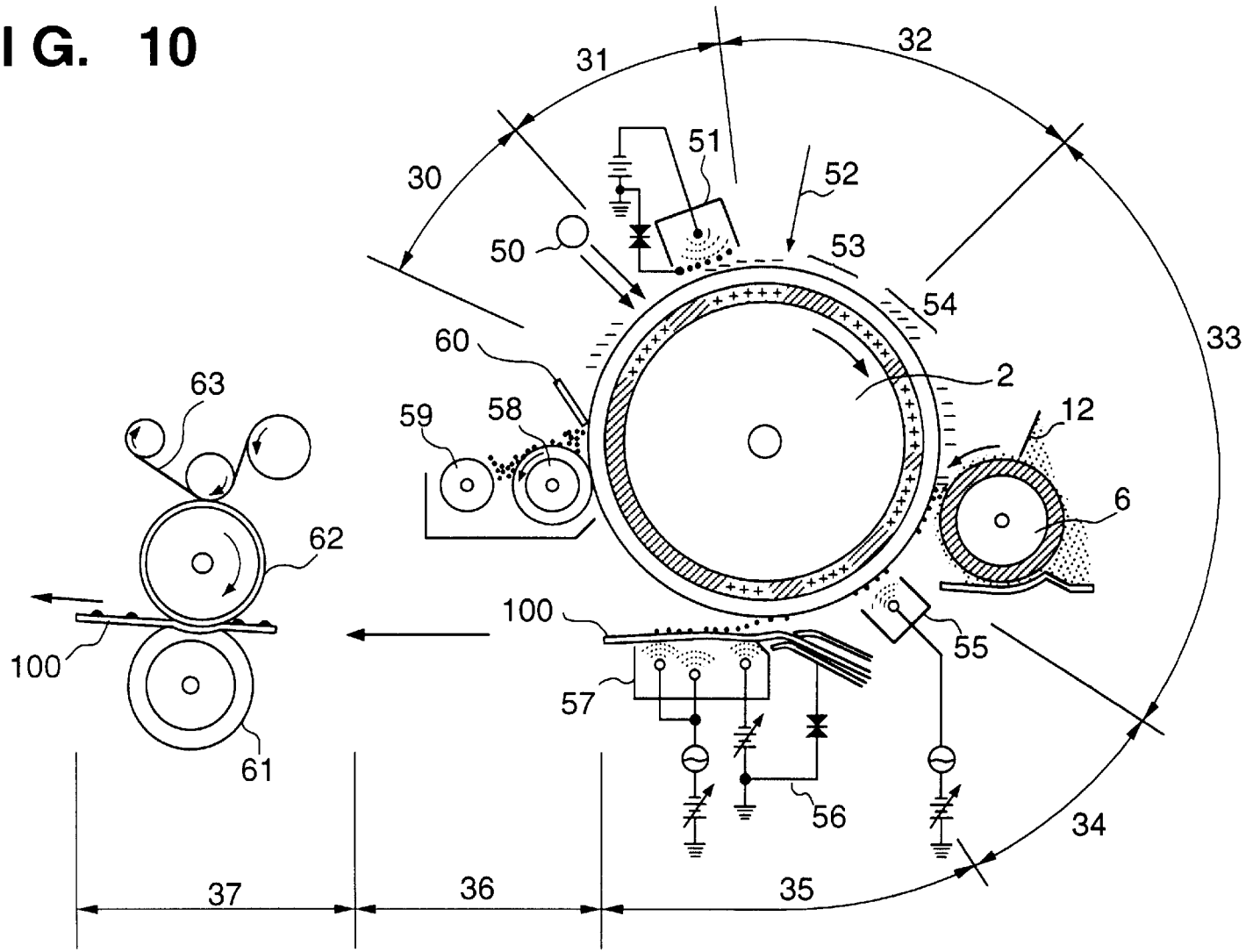
FIG. 10 is a view showing the arrangement of the main part of an image forming apparatus to which the present invention is applied.

FIG. 10 shows the arrangement of the main part of an image forming apparatus in which the toner amount adjusting member 12 according to the present invention is incorporated in a developing unit. Referring to FIG. 10, a developing section 33 having the blade member 12 is arranged at the indicated position with respect to a photosensitive drum 2, rotationally driven in the direction of arrow in FIG. 10, as the center. Above the outer surface of the photosensitive drum 2, an exposure unit 50 is disposed in a pre-exposing section 30. A primary charger 51 is disposed in a primary charging section 31. An optical image unit 52 for receiving an image is disposed in an image exposing section 32, and forms a bright portion 53 and a dark portion 54. A developing sleeve 6 is disposed in the developing section 33 to perform development with the toner described above. A pre-transfer charger 55 is disposed in a pre-transfer charging section 34. A transfer charger 56 is disposed in a transfer section 35 to charge a sheet 100. A separator/charger 57 is disposed in a separating section 36. The sheet 100 separated from the photosensitive drum 2 is sandwiched between upper and lower rollers 62 and 61 in a fixing section 37, and is fixed with the image. The upper roller 62 has a web 63. A drum cleaning section constituted by a cleaning roller 58, a cleaner screw 59, and a cleaner blade member 60 is arranged on the outer surface of the photosensitive drum 2.

In the blade member shown in FIG. 3, the end face 12B-B of the second metal member 12B as the magnetic member is sometimes subjected to KN plating (chemical nickel plating) to impart a toner impact resistance to it.

When the first and second metal members 12A and 12B are joined by partially welding them with each other by point welding, as shown in FIG. 3, the blade member warps in its longitudinal direction.

When a warp exceeding a certain degree is present in the blade member in the longitudinal direction, the toner amount adjusting function suffers.

With the blade member of this example, an allowable precision of 3/100 or less is necessary. Unless the energy required for welding is suppressed to a certain degree, the blade member warps as described above.

When the welding conditions are set to satisfy:

| | |
|---|---|
| welding energy | 32 J |
| irradiation time | 9.5 ms (1 pulse) |
| in-focus | 4.0 mm |

then the change in magnetic flux density at the welding point can be suppressed to 15 to 10 G or less. Besides, an adverse influence on the plated portion can be avoided, and an adverse influence on the straightness of the blade member can be suppressed.

As has been described above, according to the present invention, there is provided a blade member for adjusting an amount of image forming toner for an image forming apparatus, wherein members constituting the blade member are a nonmagnetic member and a magnetic member. As a result, a blade member having a high precision can be obtained.

There is also provided a blade member wherein, when welding magnetic and nonmagnetic members to each other by laser irradiation of a laser beam, the laser beam is pulsed, and the laser beam to irradiate a welding portion is in an in-focused state or a defocused state or defocused. With this blade member, a white streaking line, which is the problem in the prior art, can be suppressed.

A blade member in which a change in magnetic flux density in a portion of the magnetic member irradiated with a laser beam is set to 50 G or less is obtained.

In order to solve the problem of the developing unit, a developing unit for an image forming apparatus is obtained, which is characterized in that a blade member obtained by welding a nonmagnetic member and a magnetic member to each other by laser irradiation is used to adjust a toner amount.

An image forming apparatus is obtained, which is characterized by having a developing unit in which a blade member obtained by welding a nonmagnetic member and a magnetic member to each other by laser irradiation is used to adjust a toner amount.

As many apparently widely different embodiments of the present invention can be made without departing from the spirit and scope thereof, it is to be understood that the invention is not limited to the specific embodiments thereof except as defined in the appended claims.

What is claimed is:

1. A blade member for adjusting an amount of toner on a photosensitive member in a developing apparatus, said blade member comprising:

a nonmagnetic member joined to a magnetic member for adjusting an amount of image forming toner for an image forming apparatus, wherein said nonmagnetic and magnetic members are welded to each other at intermittent intervals by laser irradiation by a laser beam, wherein, when welding said magnetic and nonmagnetic members to each other, the laser beam intermittently is in-focused or defocused, and wherein said laser irradiation is set such that a change in magnetic flux density at an irradiated portion after laser irradiation becomes not more than 10 G in said nonmagnetic member.

2. The blade member according to claim 1, wherein said nonmagnetic material is austenite-based stainless steel, and said magnetic material is carbon steel.

3. The blade member according to claim 1, wherein said laser irradiation is set to suppress transformation of an austenite structure into ferrite.

4. A method of manufacturing a blade member composed of a first metal member having a toner amount adjusting portion and a second metal member to be joined to said first metal member, wherein said first and second metal members are joined to each other by welding with intermittent irradiation of a laser beam in a longitudinal direction, and a laser irradiation energy is adjusted so that structure transformation of said first metal member caused by a laser beam does not adversely influence toner adsorption.

5. The method according to claim 4, wherein said first metal member is austenite-based stainless steel.

6. A developing unit having a blade member for adjusting an amount of toner on a photosensitive drum in said developing unit, said blade member comprising a nonmagnetic member welded to a magnetic member by laser irradiation with a laser beam in-focused or defocused so that ferrite is not produced at a pearlite potion of said nonmagnetic member.

7. An image forming apparatus comprising said developing unit having said blade member of claim 6.

* * * * *

UNITED STATES PATENT AND TRADEMARK OFFICE

CERTIFICATE OF CORRECTION

PATENT NO. : 6,175,708 B1
DATED : January 16, 2001
INVENTOR(S) : Tsuneo Ohashi et al.

It is certified that error appears in the above-identified patent and that said Letters Patent is hereby corrected as shown below:

Sheet 9,
Figure 9, "THROGH" (both occurrences) should read -- THROUGH --.

Column 2,
Line 60, "of" should read -- of a --.

Column 3,
Line 36, "explaining" should read -- showing --.
Line 37, "explaining" should read -- showing --.

Column 5,
Line 1, "in-focus" should read -- in-focused state --.
Line 8, "caustenite" should read -- austenite --.
Line 36, "the in" should be deleted.
Line 37, "state" should be deleted.
Line 48, "of" should read -- of an --.

Column 6,
Line 38, "state or defocused." should read -- state. --.

Column 8,
Line 15, "potion" should read -- portion --.

Signed and Sealed this

Twenty-ninth Day of January, 2002

*Attest:*

*Attesting Officer*

JAMES E. ROGAN
*Director of the United States Patent and Trademark Office*